United States Patent [19]

Shih et al.

[11] 4,378,288

[45] Mar. 29, 1983

[54] COKING PROCESS BY ADDITION OF FREE RADICAL INHIBITORS

[75] Inventors: Stuart S. Shih, Cherry Hill; Philip J. Angevine, West Deptford, both of N.J.

[73] Assignee: Mobil Oil Corporation, New York, N.Y.

[21] Appl. No.: 232,606

[22] Filed: Feb. 9, 1981

[51] Int. Cl.[3] ..... C10G 9/26; C10G 9/32; C10G 9/28; C10G 9/14

[52] U.S. Cl. ..... 208/126; 208/127; 208/131

[58] Field of Search ..... 208/126, 127, 131

[56] References Cited

U.S. PATENT DOCUMENTS

| | | | |
|---|---|---|---|
| 2,781,299 | 2/1957 | Rosset | 208/127 |
| 3,347,776 | 10/1967 | Mitchell et al. | 208/131 |
| 3,687,840 | 8/1972 | Sze et al. | 208/131 |
| 4,229,283 | 10/1981 | Sosnowski | 208/127 |

*Primary Examiner*—Delbert E. Gantz
*Assistant Examiner*—Helane E. Maull
*Attorney, Agent, or Firm*—Charles A. Huggett; Michael G. Gilman; Charles J. Speciale

[57] ABSTRACT

A process for increasing coker distillate yield in a coking process by adding a small amount, generally 0.005–10% by weight of a free radical inhibitor selected from the group consisting of hydroquinone and N-phenyl-2-naphthylamine to the coker feed material.

3 Claims, 1 Drawing Figure

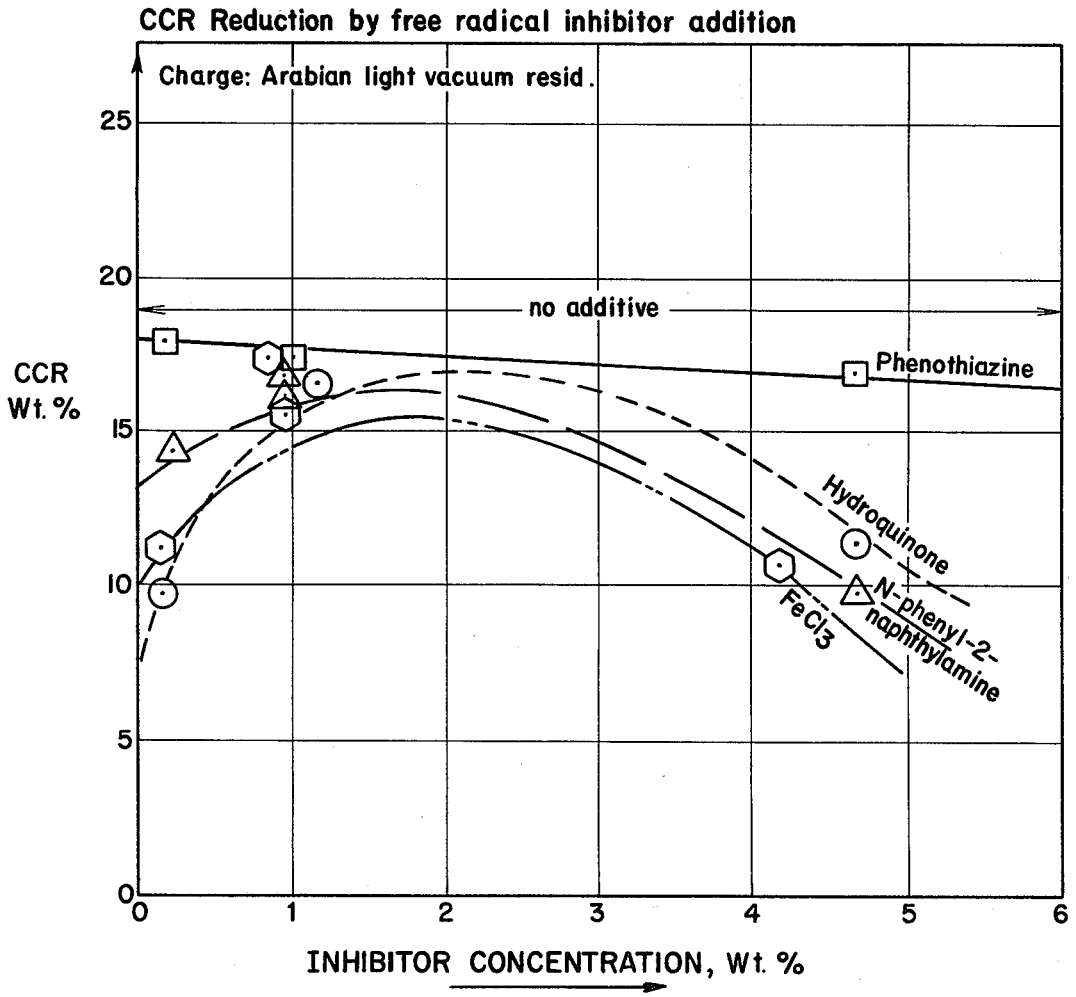
CCR Reduction by free radical inhibitor addition
Charge: Arabian light vacuum resid.
no additive
Phenothiazine
Hydroquinone
N-phenyl-2-naphthylamine
FeCl3
CCR Wt. %
INHIBITOR CONCENTRATION, Wt. %
0
5
10
15
20
25
0
1
2
3
4
5
6

COKING PROCESS BY ADDITION OF FREE RADICAL INHIBITORS

BACKGROUND OF THE INVENTION

1. Field of the Invention

This invention relates to the conversion of heavy petroleum feedstocks and more particularly to processes for coking residual petroleum feedstocks in the presence of free radical inhibitors.

2. Description of the Prior Art

Coking is an increasingly important processing area in petroleum refining. As high quality crudes become scarcer and more expensive, refineries must process increasing quantities of lower quality crudes which contain or, upon processing, form large amounts of high-boiling materials that are typically treated in coking units. Thus, the quality and quantity of products produced by coking processes can have a large impact on overall refinery yields because the relative amount of feedstock to be coked generally increases as the quality of crude oil material decreases.

Principle heavy petroleum coking feedstocks are high-boiling virgin or cracked petroleum residua such as virgin reduced crude, bottoms from vacuum distillation (vacuum reduced crude), thermal tar and other residue and blends thereof. Coking enables efficient conversion of these less desirable petroleum fractions to more desirable distillate products and a byproduct coke.

A variety of coking methods are known in the art including delayed, fluid, and moving bed coking processes.

Delayed coking is a process wherein the feedstock is preheated to a coking temperature, generally between 800° F. to about 1100° F. and more usually between about 850° F. to 950° F. The preheated feedstock is then fed to the bottom of a delayed coker drum. The coking feed is allowed to soak in its own heat in the delayed coker at a low pressure, generally from about one atmosphere to about 10 atmospheres absolute, preferably from about three atmospheres to about seven atmospheres absolute. The cracked vapors are continuously removed overhead so as to recover the distillate fuels while coke is allowed to build up in the drum to successively higher levels. When the drum is filled with coke, the preheated feed is diverted to a succeeding drum and the former drum is steamed out and cooled. The coke is then removed from the cooled drum.

Fluid coking is a process wherein feedstock is sprayed into a bed of hot fluidized coke particles in a reactor. The feedstock is cracked into lighter vapor-phase products and into coke, the coke being deposited on the particles of the fluidized bed. The particles of coke are circulated from the reactor to a burner wherein they are partially combusted with an oxygen-containing gas in a moving, fluid, or transfer line combustion zone and thereby raised in temperature, some of the heated coke particles being returned to the reactor for further use, the remainder of the coke being withdrawn as a byproduct. In a typical fluid coking unit the feedstock is converted to about 70% of normally liquid products and about 25% of coke, and 7–8% of the latter (based on charge) is consumed in the burner to provide heat for the process.

Moving bed coking is a process wherein the feedstock is uniformly distributed to the top of a mass of heated granular petroleum coke particles maintained in a reactor through which the particles downwardly pass by gravity. The liquid hydrocarbon charge is converted by the heat of the particles to produce lower-boiling vapors and a dry coke coating on the particles. The coated coke particles are withdrawn from the bottom of the reactor and either recovered as a coke byproduct or passed to a burner similar to that employed in fluid coking processes to raise the coke particle temperature for return to the coking reactor.

Condensation and thermal cracking are two major reactions which take place in the coking process. The thermal cracking results in bond-breaking and produces lighter molecules (distillates and gases). The condensation is an undesirable reaction because it produces a low value product, i.e., coke. The coke formation is believed to proceed through free radical condensation wherein the radicals are initially formed by thermal dissociation (Equation 1).

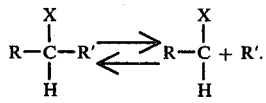

(1)

Several reactions may take place for the free radical. It may combine with hydrogen to form the stable, lighter molecule as shown in Equation 2. It also can be dehydrogenated to form an olefin (Equation 3). Moreover, it can condense with aromatic hydrocarbons to form heavier molecules (Equation 4). The condensation can be repeated forming coke (Equation 5).

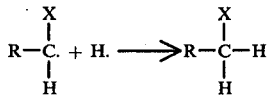

(2)

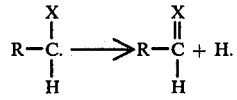

(3)

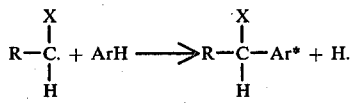

(4)

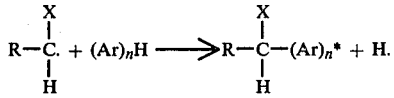

(5)

*Ar represents an aromatic moiety and n is an integer greater than 1.

The principle charging stocks for coking operations are high boiling virgin or cracked petroleum residues which may or may not be suitable as heavy fuel oils. An important use of coke is as domestic or industrial fuel although a substantial tonnage is processed and used in making carbon or graphite electrodes for use in the metals industries. However, the dynamic manner in which fluid coke is formed yields a solid product having physical properties which make it undesirable for this latter application. Delayed coking, on the other hand, when processing a sufficiently aromatic feedstock, can provide a premium quality coke product.

A primary objective of all of the various known coking processes has been to convert as large a proportion as possible of the feedstock to lighter hydrocarbon fractions while keeping coke formation to a minimum. The coker feedstock is completely converted to lighter and heavier materials. The lighter products (resulting from cracking) are gas, some gasoline, and gas oil. The heavier product (resulting from condensation reactions) is coke. The various product yields are affected by the coking tendency of the charge stock (e.g., as indicated by the Conradson Carbon Residue), by the process employed (delayed or fluid) and by the process conditions. The yield of distillates is maximized by coking at low pressures. At higher pressures more gas and coke are produced, and the liquid product contains more gasoline. The yields of gas and gasoline also increase with increasing temperatures; the yield of gas oil decreases. Moreover, the research octane number of the gasoline increases linearly with temperature: for example, from 72 at 930° F. to 87 at 1057° F. Gasolines produced at higher temperatures are unstable and require finishing operations such as clay treating or mild hydrogenation. The gases produced at higher temperatures are olefinic: at an average temperature of 955° F. they are 50% olefinic, as compared with 15% at temperatures of about 850° F.

Present delayed coker reactors must be operated within a relatively narrow range of conditions which limits the degree of control over product yield distribution and over product qualities. As noted above, a principle limitation of delayed cokers is the furnace outlet temperature which in turn limits the temperatures in the delayed coking drums. This limitation is of relatively minor importance in plants where the more valuable gaseous and liquid products produced by delayed coking are a relatively small percentage of the total volume of similar products produced in the complete refinery. However, improved product flexibility would be a considerable asset to the process and is particularly important in refineries processing heavy crudes such that the coker products have a major influence on overall refinery yields. Inasmuch as high quality crudes are becoming increasingly scarce and expensive, the processing of heavy crudes is becoming increasingly important today.

The literature is replete with various means employed to decrease the formation of coke, carbonaceous deposits and other contaminants in a wide variety of hydrocarbon processes. For the purpose of illustrating the prior art, the following patents are considered exemplary.

U.S. Pat. No. 3,342,723 discloses a method of inhibiting the formation of coke-like deposits in oil refining apparatus by the addition of various antifouling agents to a hydrocarbon liquid. Typical antifouling agents are aromatic compounds such as hydroquinone, orthophenylene diamine, and catechol. The antifouling agents are employed in the treatment of any component of petroleum which is exposed to high temperatures.

In U.S. Pat. No. 3,654,129, a polymerization inhibitor is added to a coke-forming hydrocarbon charge stock to decrease coke formation and increase catalyst life. The inhibitor is selected from the group consisting of phenols, aromatic amines and thiophenols.

U.S. Pat. No. 3,772,182 discloses a process for inhibiting fouling in petroleum refining and chemical processing equipment by means of an antifouling composition which contains a diarylamine compound such as diphenylamine.

Although the suppression of coke is considered desirable for one or more reasons, e.g., to extend catalyst life, prevent heat transfer loss due to the formation of high temperature deposits on metal surfaces and/or otherwise increase the yield by minimizing the loss represented by deposition of coke and other carbonaceous material, the prior art does not suggest deliberately inhibiting the formation of coke in a hydrocarbon process designed to yield a coke product such as a delayed, fluid or moving bed coking process.

SUMMARY OF THE INVENTION

The invention provides a method for increasing coker distillate yield in a coking process by adding a small amount, generally 0.005 to 10.0% by weight, of a free radical inhibitor to the coker feed material. It has been found that the addition of free radical inhibitors to a coker feed will increase coker distillate yield and coker throughput by significantly reducing the coke make.

BRIEF DESCRIPTION OF THE DRAWING

The graph shows the addition of various free radical inhibitors to an Arab Light vacuum residuum and the effect on the CCR (Conradson Carbon Residue) test (ASTM D 189).

DESCRIPTION OF PREFERRED EMBODIMENTS

Satisfactory increase in coker distillate yield and coke throughput may be attained by the use of a wide variety of free radical inhibitors which inhibit the condensation reactions illustrated in Equations 4 and 5, supra, and thus reduce coke yield. Functionally the inhibitors are nitrogen, oxygen, or sulfur-containing compounds which are well-known as polymerization inhibitors or stabilizers for unsaturated compounds such as butadiene isoprene and/or 1,3-pentadiene, etc., which tend to polymerize in solutions exposed to elevated temperatures.

Typical free radical inhibitors which can be employed include furfural, benzaldehyde, nitrobenzene, nitronaphthalene or its nuclear substitution derivative, $\alpha,\beta$-unsaturated nitrile, aromatic mercaptan, aliphatic nitro compound, cinnamic aldehyde, aldol, $\alpha$-nitroso-$\beta$-naphthol, isatin, morpholine, aliphatic tertiary mercaptan, alkyl nitrite, $\beta,\beta'$thiodipropionitrile or N-nitroso-N-methylaniline.

Other free radical inhibitors which can be used are the aromatic nitro compounds such as o-nitrophenol, 2,4-dinitrophenol, 2,4-dinitrophenylhydrazine, 4-nitrophthalimide and nitrobenzene.

Still another group of well-known free radical inhibitors which can be used in the invention include, for example, dinitrodurene, tetramethylbenzoquinone, chloranil, hydroquinone, phenylhydrazine, $FeCl_3$, methylene blue, sodium nitrite, sulfur, phenolic compounds such as 4-tertiary butyl catechol, and aromatic amines such as N-phenyl-2-naphthylamine and $\beta$-naphthylamine.

The amount of inhibitor employed will be in the range of 0.005 to 10.0 weight percent, and preferably 0.05–5 weight percent, based on the weight of the coker feedstock.

The following examples illustrate the best mode now contemplated for carrying out the invention.

EXAMPLE 1

An Arab Light vacuum residuum containing various free radical inhibitors was tested by the Conradson Carbon Residue test (ASTM D 189).

The vacuum residuum feed had the following properties:

| | |
|---|---|
| Gravity, °API | 8.3 |
| Hydrogen, wt. % | 10.67 |
| Sulfur, wt. % | 3.93 |
| Nitrogen, Wt % | 0.28 |
| Asphaltenes, wt. % | 13.6 |
| Paraffins, wt. % | 1.4 |
| Naphthenes, wt. % | 1.9 |
| Aromatics, wt. % | 96.7 |
| CCR, Wt % | 19 |

As shown by the graph illustrated in the accompanying drawing in which the abscissa represents inhibitor concentration in weight percent and the ordinate represents CCR (Conradson Carbon Residue) content, it will be noted that the addition of a small amount of hydroquinone, N-phenyl-2-naphthylamine or ferric chloride reduces the CCR content by up to 50% by weight. Except for phenothiazine, significant reduction of CCR content was obtained. Since coke yield is proportional to the coker feed CCR content, the reduced coke make provides increased coker distillate yield and coker throughput.

What is claimed:

1. In a coking process wherein a heavy petroleum feedstock is subject to coking conditions of temperature and pressure to produce coke and lighter gaseous and liquid hydrocarbon product, the improvement which comprises carrying out the coking process in the presence of 0.005 to 10.0 wt. % of a free radical inhibitor selected from the group consisting of hydroquinone and N-phenyl-2-naphthylamine.

2. The process of claim 1 wherein the inhibitor is present in an amount ranging from 0.05 to 5.0 wt. %.

3. The process of claim 2 wherein the coking process is a delayed, fluid or moving bed coking process.

* * * * *